US006801003B2

(12) United States Patent
Schanberger et al.

(10) Patent No.: US 6,801,003 B2
(45) Date of Patent: Oct. 5, 2004

(54) SYSTEMS AND METHODS FOR SYNCHRONIZING LIGHTING EFFECTS

(75) Inventors: Eric K. Schanberger, Cambridge, MA (US); Kevin J. Dowling, Westford, MA (US)

(73) Assignee: Color Kinetics, Incorporated, Boston, MA (US)

( * ) Notice: Subject to any disclaimer, the term of this patent is extended or adjusted under 35 U.S.C. 154(b) by 0 days.

(21) Appl. No.: 10/143,549

(22) Filed: May 10, 2002

(65) Prior Publication Data

US 2002/0195975 A1 Dec. 26, 2002

Related U.S. Application Data

(63) Continuation-in-part of application No. 10/040,253, filed on Oct. 25, 2001, and a continuation-in-part of application No. 10/040,291, filed on Oct. 25, 2001, and a continuation-in-part of application No. 10/040,292, filed on Oct. 25, 2001, and a continuation-in-part of application No. 10/040,266, filed on Oct. 25, 2001, and a continuation-in-part of application No. 10/045,629, filed on Oct. 25, 2001, and a continuation-in-part of application No. 10/040,252, filed on Oct. 25, 2001, and a continuation-in-part of application No. 09/805,368, filed on Mar. 13, 2001, and a continuation-in-part of application No. 09/805,590, filed on Mar. 13, 2001.

(60) Provisional application No. 60/290,101, filed on May 10, 2001.

(51) Int. Cl.[7] ..... G05F 1/00

(52) U.S. Cl. ..... 315/291; 315/313

(58) Field of Search ..... 315/194, 291, 315/312, 317, 292, 294, 295, 313; 362/234; 323/235, 237

(56) References Cited

U.S. PATENT DOCUMENTS

| | | | | |
|---|---|---|---|---|
| 2,909,097 | A | 10/1959 | Alden et al. | 353/31 |
| 3,318,185 | A | 5/1967 | Kott | 359/629 |
| 3,561,719 | A | 2/1971 | Grindle | 248/343 |

(List continued on next page.)

FOREIGN PATENT DOCUMENTS

| | | |
|---|---|---|
| AU | 6 267 9 | 12/1996 |
| CA | 2 178 432 | 12/1996 |

(List continued on next page.)

OTHER PUBLICATIONS

"LM117/LM317A/LM317 3–Terminal Adjustable Regulator", National Semiconductor Corporation, May 1997, pp. 1–20.

(List continued on next page.)

*Primary Examiner*—Hoang V. Nguyen
(74) *Attorney, Agent, or Firm*—Lowrie, Lando & Anastasi, LLP

(57) ABSTRACT

In one example, a lighting apparatus comprises a processor wherein the processor is configured to control a color-changing lighting effect generated by the lighting apparatus; wherein the processor is further configured to monitor an operating power source; and wherein the processor is further configured to synchronize the color-changing lighting effect in coordination with a parameter of the operating power source.

70 Claims, 3 Drawing Sheets

U.S. PATENT DOCUMENTS

| | | | | |
|---|---|---|---|---|
| 3,586,936 | A | 6/1971 | McLeroy | 318/118 |
| 3,601,621 | A | 8/1971 | Ritchie | 307/116 |
| 3,643,088 | A | 2/1972 | Osteen et al. | 240/52 |
| 3,746,918 | A | 7/1973 | Drucker et al. | 315/77 |
| 3,818,216 | A | 6/1974 | Larraburu | 240/41.3 |
| 3,832,503 | A | 8/1974 | Crane | 200/51 R |
| 3,845,291 | A | 10/1974 | Portyrata | |
| 3,858,086 | A | 12/1974 | Anderson et al. | 315/49 |
| 3,909,670 | A | 9/1975 | Wakamatsu et al. | 315/276 |
| 3,924,120 | A | 12/1975 | Cox, III | 250/199 |
| 3,958,885 | A | 5/1976 | Stockinger et al. | 356/139 |
| 3,974,637 | A | 8/1976 | Bergey et al. | 58/50 R |
| 4,001,571 | A | 1/1977 | Martin | 240/9 R |
| 4,054,814 | A | 10/1977 | Fegley et al. | 315/71 |
| 4,082,395 | A | 4/1978 | Donato et al. | 339/21 R |
| 4,096,349 | A | 6/1978 | Donato | 174/68 R |
| 4,241,295 | A | 12/1980 | Williams, Jr. | 315/294 |
| 4,272,689 | A | 6/1981 | Crosby et al. | 307/147 |
| 4,273,999 | A | 6/1981 | Pierpoint | 250/205 |
| 4,298,869 | A | 11/1981 | Okuno | 340/782 |
| 4,305,117 | A | 12/1981 | Evans | 362/96 |
| 4,317,071 | A | 2/1982 | Murad | |
| 4,329,625 | A | 5/1982 | Nishizawa et al. | 315/158 |
| 4,367,464 | A | 1/1983 | Kurahashi et al. | 346/701 |
| 4,388,567 | A | 6/1983 | Yamazaki et al. | 315/291 |
| 4,388,589 | A | 6/1983 | Molldrem, Jr. | 324/96 |
| 4,392,187 | A | 7/1983 | Bornhorst | 362/233 |
| 4,394,716 | A | 7/1983 | Campagna et al. | 362/158 |
| 4,396,871 | A | 8/1983 | Scheuermann | 315/291 |
| 4,420,711 | A | 12/1983 | Takahashi et al. | 315/296 |
| 4,500,796 | A | 2/1985 | Quin | 307/147 |
| 4,564,889 | A | 1/1986 | Bolson | |
| 4,616,298 | A | 10/1986 | Bolson | |
| 4,622,881 | A | 11/1986 | Rand | 84/464 R |
| 4,625,152 | A | 11/1986 | Nakai | 315/317 |
| 4,633,161 | A | 12/1986 | Callahan et al. | 323/242 |
| 4,635,052 | A | 1/1987 | Aoike et al. | 340/311 |
| 4,647,217 | A | 3/1987 | Havel | 368/10 |
| 4,656,398 | A | 4/1987 | Michael et al. | 315/293 |
| 4,668,895 | A | 5/1987 | Schneiter | 315/158 |
| 4,682,079 | A | 7/1987 | Sanders et al. | 315/186 |
| 4,686,425 | A | 8/1987 | Havel | 315/152 |
| 4,687,340 | A | 8/1987 | Havel | 368/10 |
| 4,688,154 | A | 8/1987 | Nilssen | 362/147 |
| 4,688,869 | A | 8/1987 | Kelly | 439/209 |
| 4,695,769 | A | 9/1987 | Schweickardt | 315/158 |
| 4,701,669 | A | 10/1987 | Head et al. | 315/155 |
| 4,704,660 | A | 11/1987 | Robbins | 362/32 |
| 4,705,406 | A | 11/1987 | Havel | 368/10 |
| 4,707,141 | A | 11/1987 | Havel | 368/4 |
| 4,727,289 | A | 2/1988 | Uchida | 315/71 |
| 4,740,882 | A | 4/1988 | Miller | 364/132 |
| 4,753,148 | A | 6/1988 | Johnson | 84/464 R |
| 4,771,274 | A | 9/1988 | Havel | 340/703 |
| 4,780,621 | A | 10/1988 | Bartleucci et al. | 307/11 |
| 4,780,917 | A | 11/1988 | Hancock | 4/544 |
| 4,818,072 | A | 4/1989 | Mohebban | 350/336 |
| 4,823,069 | A | 4/1989 | Callahan et al. | 323/235 |
| 4,837,565 | A | 6/1989 | White | 340/762 |
| 4,843,627 | A | 6/1989 | Stebbins | 381/110 |
| 4,844,333 | A | 7/1989 | Davis | 236/51 |
| 4,845,481 | A | 7/1989 | Havel | 340/762 |
| 4,845,745 | A | 7/1989 | Havel | 379/354 |
| 4,863,223 | A | 9/1989 | Weissenbach et al. | 312/209 |
| 4,874,320 | A | 10/1989 | Freed et al. | 439/115 |
| 4,887,074 | A | 12/1989 | Simon et al. | 340/782 |
| 4,920,465 | A | 4/1990 | Sargent | |
| 4,922,154 | A | 5/1990 | Cacoub | 315/149 |
| 4,934,852 | A | 6/1990 | Havel | 400/704 |
| 4,962,687 | A | 10/1990 | Belliveau et al. | 84/464 R |
| 4,965,561 | A | 10/1990 | Havel | |
| 4,973,835 | A | 11/1990 | Kurosu et al. | 250/214 AL |
| 4,975,629 | A | 12/1990 | Callahan et al. | 323/235 |
| 4,979,081 | A | 12/1990 | Leach et al. | 362/219 |
| 4,980,806 | A | 12/1990 | Taylor et al. | 362/85 |
| 4,992,704 | A | 2/1991 | Stinson | 315/312 |
| 5,003,227 | A | 3/1991 | Nilssen | 315/161 |
| 5,008,595 | A | 4/1991 | Kazar | 315/178 |
| 5,010,459 | A | 4/1991 | Taylor et al. | 362/85 |
| 5,027,262 | A | 6/1991 | Freed | 362/249 |
| 5,034,807 | A | 7/1991 | Von Kohorn | 358/84 |
| 5,072,216 | A | 12/1991 | Grange | 340/825.52 |
| 5,078,039 | A | 1/1992 | Tulk et al. | 84/464 R |
| 5,083,063 | A | 1/1992 | Brooks | 315/294 |
| 5,117,233 | A | 5/1992 | Hamos et al. | 340/825.69 |
| 5,122,936 | A | 6/1992 | Guthrie | |
| 5,126,634 | A | 6/1992 | Johnson | 315/71 |
| 5,128,595 | A | 7/1992 | Hara | 315/312 |
| 5,134,387 | A | 7/1992 | Smith et al. | 340/701 |
| 5,142,199 | A | 8/1992 | Elwell | 315/154 |
| 5,154,641 | A | 10/1992 | McLaughlin | 439/621 |
| 5,164,715 | A | 11/1992 | Kashiwabara et al. | 340/716 |
| 5,171,429 | A | 12/1992 | Yasuo | |
| 5,184,114 | A | 2/1993 | Brown | 340/701 |
| 5,194,854 | A | 3/1993 | Havel | 340/815.1 |
| 5,209,560 | A | 5/1993 | Taylor et al. | 362/85 |
| 5,225,765 | A | 7/1993 | Callahan et al. | 323/235 |
| 5,226,723 | A | 7/1993 | Chen | 362/241 |
| 5,254,910 | A | 10/1993 | Yang | 315/313 |
| 5,256,948 | A | 10/1993 | Boldin et al. | 315/313 |
| 5,267,129 | A | 11/1993 | Anderson | |
| 5,282,121 | A | 1/1994 | Bornhorst et al. | 362/294 |
| 5,294,865 | A | 3/1994 | Haraden | 315/58 |
| 5,301,090 | A | 4/1994 | Hed | 362/32 |
| 5,307,295 | A | 4/1994 | Taylor et al. | 364/578 |
| 5,319,301 | A | 6/1994 | Callahan et al. | 323/235 |
| 5,329,431 | A | 7/1994 | Taylor et al. | 362/85 |
| 5,350,977 | A | 9/1994 | Hamamoto et al. | 315/291 |
| 5,357,170 | A | 10/1994 | Luchaco et al. | 315/159 |
| 5,371,618 | A | 12/1994 | Tai et al. | 359/53 |
| 5,374,876 | A | 12/1994 | Horibata et al. | 315/313 |
| 5,388,357 | A | 2/1995 | Malita | 40/570 |
| 5,402,702 | A | 4/1995 | Hata | 84/464 R |
| 5,404,282 | A | 4/1995 | Klinke et al. | 362/249 |
| 5,406,176 | A | 4/1995 | Sugden | 315/292 |
| 5,410,328 | A | 4/1995 | Yoksza et al. | 345/82 |
| 5,412,284 | A | 5/1995 | Moore et al. | 315/155 |
| 5,412,552 | A | 5/1995 | Fernandes | 362/250 |
| 5,420,482 | A | 5/1995 | Phares | 315/292 |
| 5,421,059 | A | 6/1995 | Leffers, Jr. | 16/57.4 R |
| 5,432,408 | A | 7/1995 | Matsuda et al. | 315/200 R |
| 5,436,535 | A | 7/1995 | Yang | 315/313 |
| 5,455,490 | A | 10/1995 | Callahan et al. | 315/194 |
| 5,461,188 | A | 10/1995 | Drago et al. | 84/600 |
| 5,463,280 | A | 10/1995 | Johnson | 315/187 |
| 5,465,144 | A | 11/1995 | Parker et al. | 356/139.06 |
| 5,489,827 | A | 2/1996 | Xia | 315/294 |
| 5,491,402 | A | 2/1996 | Small | 323/282 |
| 5,504,395 | A | 4/1996 | Johnson et al. | 315/71 |
| 5,530,322 | A | 6/1996 | Ference et al. | 315/295 |
| 5,539,624 | A | 7/1996 | Dougherty | |
| 5,545,950 | A | 8/1996 | Cho | 315/56 |
| 5,561,346 | A | 10/1996 | Byrne | 313/512 |
| 5,569,371 | A | 10/1996 | Perling | 210/85 |
| 5,575,459 | A | 11/1996 | Anderson | 362/240 |
| 5,575,554 | A | 11/1996 | Guritz | 362/103 |
| 5,592,051 | A | 1/1997 | Korkala | 315/210 |
| 5,629,607 | A | 5/1997 | Callahan et al. | 323/237 |
| 5,640,061 | A | 6/1997 | Bornhorst et al. | 307/150 |
| 5,642,129 | A | 6/1997 | Zavracky et al. | 345/100 |
| 5,672,941 | A | 9/1997 | Callahan et al. | 315/194 |

| | | | | |
|---|---|---|---|---|
| 5,673,059 | A | 9/1997 | Zavracky et al. | 345/8 |
| 5,701,058 | A | 12/1997 | Roth | 315/158 |
| 5,721,471 | A | 2/1998 | Begemann et al. | 315/158 |
| 5,725,761 | A | 3/1998 | Phillips | 210/169 |
| 5,734,590 | A | 3/1998 | Tebbe | 364/514 A |
| 5,751,118 | A | 5/1998 | Mortimer | 315/291 |
| 5,752,766 | A | 5/1998 | Bailey et al. | |
| 5,769,527 | A | 6/1998 | Taylor et al. | 362/85 |
| 5,803,579 | A | 9/1998 | Turnbull et al. | 362/83.1 |
| 5,808,689 | A | 9/1998 | Small | 348/476 |
| 5,821,695 | A | 10/1998 | Vilanilam et al. | 315/58 |
| 5,821,703 | A | 10/1998 | Callahan et al. | 315/317 |
| 5,823,431 | A | 10/1998 | Pierce | |
| 5,848,837 | A | 12/1998 | Gustafson | 362/235 |
| 5,850,126 | A | 12/1998 | Kanbar | 315/200 A |
| 5,851,063 | A | 12/1998 | Doughty et al. | 362/231 |
| 5,852,658 | A | 12/1998 | Knight et al. | 379/106.03 |
| RE36,030 | E | 1/1999 | Nadeau | |
| 5,859,508 | A | 1/1999 | Ge et al. | 315/366 |
| 5,896,010 | A | 4/1999 | Mikolajczak et al. | 315/77 |
| 5,912,653 | A | 6/1999 | Fitch | 345/87 |
| 5,924,784 | A | 7/1999 | Chliwnyj et al. | 362/234 |
| 5,927,845 | A | 7/1999 | Gustafson et al. | 362/152 |
| 5,946,209 | A | 8/1999 | Eckel et al. | 364/143 |
| 5,952,680 | A | 9/1999 | Strite | 257/88 |
| 5,959,547 | A | 9/1999 | Tubel et al. | 340/853.2 |
| 5,963,185 | A | 10/1999 | Havel | 345/83 |
| 5,974,553 | A | 10/1999 | Gandar | 713/300 |
| 6,008,783 | A | 12/1999 | Kitagawa et al. | 345/39 |
| 6,016,038 | A | 1/2000 | Mueller et al. | 315/291 |
| 6,018,237 | A | 1/2000 | Havel | 324/45 |
| 6,021,960 | A | 2/2000 | Kehat | |
| 6,025,550 | A | 2/2000 | Kato | 84/464 A |
| 6,030,108 | A | 2/2000 | Ishiharada et al. | 362/562 |
| 6,031,343 | A | 2/2000 | Recknagel et al. | 315/292 |
| 6,036,333 | A | 3/2000 | Spiller | |
| 6,068,383 | A | 5/2000 | Robertson et al. | 362/84 |
| 6,072,280 | A | 6/2000 | Allen | 315/185 S |
| 6,095,661 | A | 8/2000 | Lebens et al. | 362/184 |
| 6,097,352 | A | 8/2000 | Zavracky et al. | 345/7 |
| 6,132,072 | A | 10/2000 | Turnbull et al. | 362/494 |
| 6,135,604 | A | 10/2000 | Lin | |
| 6,150,774 | A | 11/2000 | Mueller et al. | 315/291 |
| 6,166,496 | A | 12/2000 | Lys et al. | 315/316 |
| 6,175,201 | B1 | 1/2001 | Sid | |
| 6,183,086 | B1 | 2/2001 | Neubert | 351/221 |
| 6,184,628 | B1 | 2/2001 | Ruthenberg | |
| 6,196,471 | B1 | 3/2001 | Ruthenberg | 239/18 |
| 6,211,626 | B1 | 4/2001 | Lys et al. | 315/291 |
| 6,215,409 | B1 | 4/2001 | Blach | 340/815.4 |
| 6,250,774 | B1 | 6/2001 | Begemann et al. | 362/231 |
| 6,252,358 | B1 | 6/2001 | Xydis et al. | 315/295 |
| 6,292,901 | B1 | 9/2001 | Lys et al. | 713/300 |
| 6,340,868 | B1 | 1/2002 | Lys et al. | 315/185 |
| 6,459,919 | B1 | 10/2002 | Lys et al. | 600/407 |
| 2001/0033488 | A1 | 10/2001 | Chliwnji et al. | |
| 2002/0048168 | A1 * | 4/2002 | Dowling et al. | 362/234 |

FOREIGN PATENT DOCUMENTS

| | | | | |
|---|---|---|---|---|
| EP | 0495305 | A2 | 7/1992 | |
| EP | 0534710 | B1 | 1/1996 | |
| EP | 0752632 | A2 | 1/1997 | |
| EP | 0752632 | A3 | 8/1997 | |
| EP | 0823812 | A2 | 2/1998 | |
| EP | 0935234 | A1 | 8/1999 | |
| EP | 0942631 | A2 | 9/1999 | |
| EP | 1020352 | A2 | 7/2000 | |
| EP | 1113215 | A2 | 7/2001 | |
| FR | 88 17359 | | 12/1998 | |
| GB | 1 439 924 | A | 6/1976 | G05B/19/02 |
| GB | 2 029 135 | A | 3/1980 | H05B/37/02 |
| GB | 2045098 | A | 10/1980 | |
| GB | 2135536 | A | 8/1984 | |
| GB | 2176042 | A | 12/1986 | |
| JP | 06043830 | | 2/1994 | |
| JP | 7-39120 | | 7/1995 | |
| JP | 8-106264 | | 4/1996 | |
| JP | 9 320766 | | 12/1997 | |
| WO | WO 89/05086 | | 6/1989 | |
| WO | WO 94/18809 | | 8/1994 | |
| WO | WO 95/13498 | | 5/1995 | |
| WO | WO 96/41098 | | 12/1996 | |

OTHER PUBLICATIONS

"DS96177 RS–485 / RS–422 Differential Bus Repeater", National Semiconductor Corporation, Feb. 1996, pp. 1–8.

"DS2003 / DA9667 / DS2004 High Current / Voltage Darlington Drivers", National Semiconductor Corporation, Dec. 1995, pp. 1–8.

"LM140A /LM140 / LM7800C Series 3—Terminal Positive Regulators", National Semiconductor Corporation, Jan. 1995, pp. 1–14.

High End Systems, Inc., Trackspot User Manual, Aug. 1997, Excerpts (Cover, Title page, pp. ii through iii and 2–13 through 2–14).

Artistic License, AL4000 DMX512 Processors, Revision 3.4, Jun. 2000, Excerpts (Cover, pp. 7,92 through 102).

Artistic License, Miscellaneous Drawings (3 sheets) Jan. 12, 1995.

Artistic License, Miscellaneous Documents (2 sheets Feb. 1995 and Apr. 1996).

Newnes's Dictionary of Electronics, Fourth Edition, S.W. Amos, et al., Preface to First Edition, pp. 278–279.

"http://www.luminus.cx/projects/chaser", (Nov. 13, 2000), pp. 1–16.

* cited by examiner

SYSTEMS AND METHODS FOR SYNCHRONIZING LIGHTING EFFECTS

CROSS REFERENCES TO RELATED APPLICATIONS

This application claims the benefit under 35 U.S.C. §119 (e) of U.S. provisional application Serial No. 60/290,101, filed May 10, 2001, entitled "SYSTEMS AND METHODS FOR SYNCHRONIZING ILLUMINATION SYSTEMS."

This application also claims the benefit under 35 U.S.C. §120 as a continuation-in-part (CIP) of the following U.S. non-provisional applications:

Ser. No. 10/040,253, filed Oct. 25, 2001, entitled METHODS AND APPARATUS FOR ILLUMINATION OF LIQUIDS;

Ser. No. 10/040,291, filed Oct. 25, 2001, entitled METHODS AND APPARATUS FOR REMOTELY CONTROLLED ILLUMINATION OF LIQUIDS;

Ser. No. 10/040,292, filed Oct. 25, 2001, entitled LIGHT SOURCES FOR ILLUMINATION OF LIQUIDS;

Ser. No. 10/040,266, filed Oct. 25, 2001, entitled METHODS AND APPARATUS FOR SENSOR RESPONSIVE ILLUMINATION OF LIQUIDS;

Ser. No. 10/045,629, filed Oct. 25, 2001, entitled METHODS AND APPARATUS FOR CONTROLLING ILLUMINATION; and Ser. No. 10/040,252, filed Oct. 25, 2001, entitled LIGHT FIXTURES FOR ILLUMINATION OF LIQUIDS.

Each of the foregoing applications is hereby incorporated herein by reference.

Each of the foregoing applications is hereby incorporated herein by reference.

This application also claims the benefit under 35 U.S.C. §120 as a continuation-in-part (CIP) of the following U.S. non-provisional applications:

Ser. No. 09/805,368, filed Mar. 13, 2001, entitled LIGHT-EMITTING DIODE BASED PRODUCTS; and Ser. No. 09/805,590, filed Mar. 13, 2001, entitled LIGHT-EMITTING DIODE BASED PRODUCTS.

FIELD OF THE INVENTION

The invention generally relates to light emitting diode devices. More particularly, various embodiments of the invention relate to illumination systems and methods for controlling such systems.

DESCRIPTION OF RELATED ART

There are specialized lighting systems that can be arranged to provide color-changing lighting effects (e.g. color-changing LED lighting systems or lighting systems with moving filters or the like). Some such systems may be arranged in a network configurations to generate coordinated lighting effects. Lighting systems to generate coordinated lighting effects typically are popular in theater lighting and are also becoming popular in other venues where color changing lighting effects are desirable. There are also color changing lighting systems that are not associated with a network. Such systems may include a number of lighting components that may not be synchronized.

SUMMARY OF THE INVENTION

An embodiment of the present invention is a lighting apparatus. The lighting apparatus comprises a processor wherein the processor is configured to control a color-changing lighting effect generated by the lighting apparatus; wherein the processor is further configured to monitor an operating power source; and wherein the processor is further configured to synchronize the color-changing lighting effect in coordination with a parameter of the operating power source.

An embodiment of the present invention is a lighting apparatus. The lighting apparatus comprises a processor wherein the processor is configured to execute a program to control a lighting effect generated by the lighting apparatus; the processor is further configured to monitor an operating power source; and the processor is further configured to synchronize the execution of the program in coordination with a parameter of the operating power source.

An embodiment of the present invention is a lighting apparatus. The lighting apparatus comprises a processor wherein the processor is configured to control a lighting effect generated by the lighting apparatus; the processor is further configured to monitor a parameter of an operating power source; and the processor is further configured to synchronize the lighting effect in coordination with the parameter.

An embodiment of the present invention is a method of generating a lighting effect. The method comprises the steps of: providing an lighting apparatus; providing power to the lighting apparatus; causing the lighting apparatus to monitor at least one parameter of the power provided to the lighting apparatus; and causing the lighting apparatus to generate a color changing lighting effect in sync with the at least one parameter.

An embodiment of the present invention is a lighting apparatus. The lighting apparatus comprises a processor wherein the processor is configured to execute a program to control a lighting effect generated by the lighting apparatus; the processor is further configured to receive a synchronizing signal from an external source; and the processor is further configured to synchronize the execution of the program in coordination the synchronizing signal.

BRIEF DESCRIPTION OF THE FIGURES

The following figures depict certain illustrative embodiments of the invention in which like reference numerals refer to like elements. These depicted embodiments are to be understood as illustrative of the invention and not as limiting in any way.

DETAILED DESCRIPTION

Figure 1:
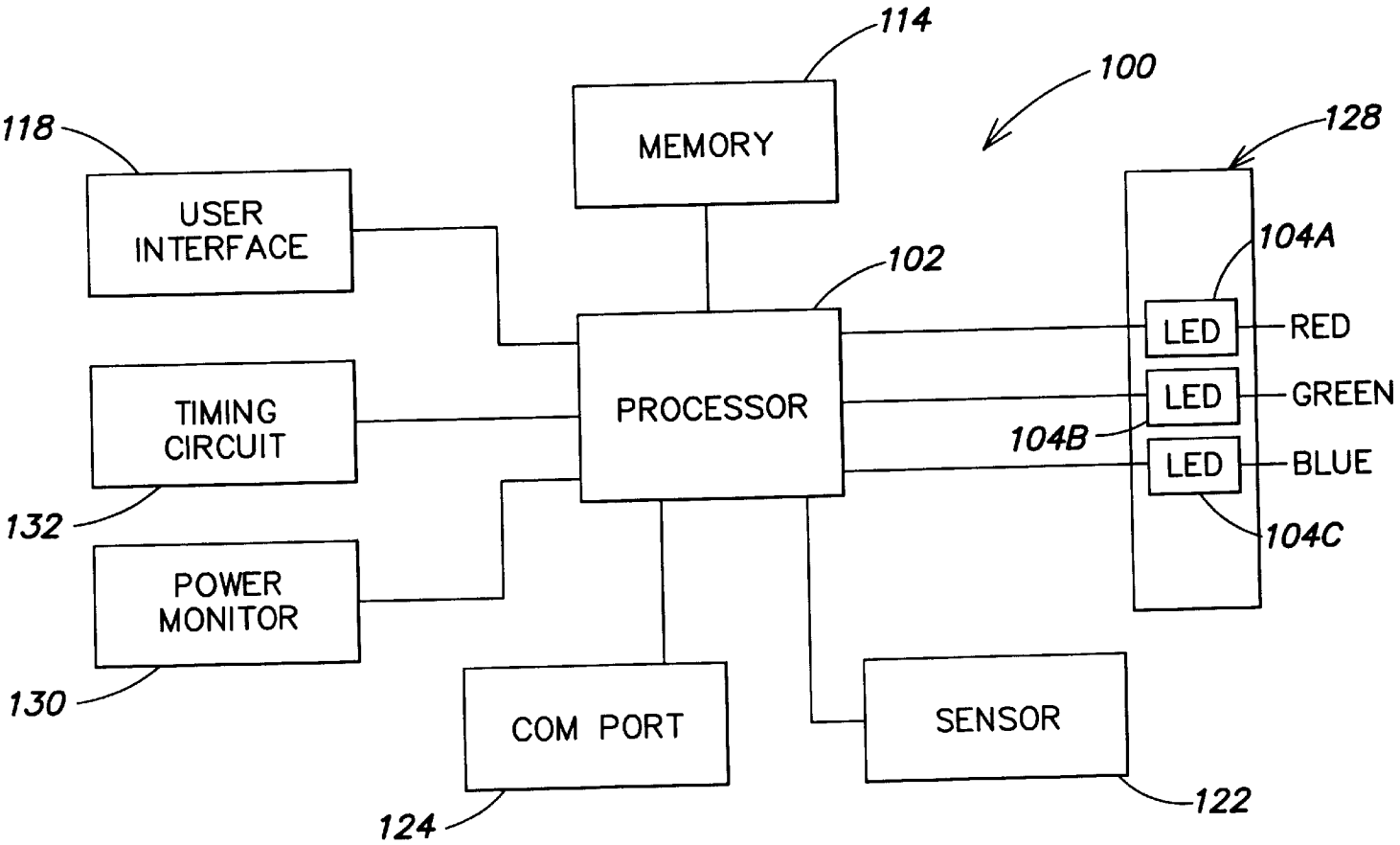
FIG. 1 is a lighting apparatus according to the principles of the present invention.

The description below pertains to several illustrative embodiments of the invention. Although many variations of the invention may be envisioned by one skilled in the art, such variations and improvements are intended to fall within the compass of this disclosure. Thus, the scope of the invention is not to be limited in any way by the disclosure below.

Applicants have recognized and appreciated that there are lighting applications in which it may be desirable to coordinate the light output of multiple light sources that are not necessarily configured in a network environment, as discussed above. For example, it may be desirable to change all the non-networked lights in a room or section of a room simultaneously so they are the same color at any one time but continually changing at a particular rate. Such an effect is termed a "color wash." A color wash might provide the following sequence: red to orange to yellow to green to blue to orange and so on. Upon power-up, all the lights may initiate the same state and the color wash may appear synchronized. If the color wash speed is relatively slow and the duration of the cycle through the wash is significant, say a minute or more, than the lights will appear synchronized. But the appearance is deceiving; there is no coordinating signal to insure that the lights are, in fact, synchronized. The scheme depends on the independent internal clocks staying in synchronization and some event to start the effect, typically power-up. Over time, the lights become out of phase with one another and may no longer be synchronous. This is due to slight variations over time, or drift, in the timing elements common to all microprocessor circuits. These elements are subject to variation because of the manufacturing process, temperature variations etc. This drift, while slow, is observable, and if the timing of the events controlled by the microprocessor is rapid, it will be evident within tens of minutes or certainly within hours.

It should be appreciated that the above discussion of a "color-wash" lighting effect is for purposes of illustration only, and that any of a variety of lighting effects may be subject to similar synchronization issues. In view of the foregoing, Applicants have recognized and appreciated that it would be useful to provide lighting systems that can produce synchronized lighting effects without necessarily requiring a network configuration.

Accordingly, one aspect of the present invention is directed to a lighting system that generates synchronized lighting effects. In an embodiment, the lighting system monitors a power source and synchronizes the lighting effects it generates with a parameter of the power source. For example, the lighting system may be attached to an A.C. power source and the lighting system may include a processor configured to execute a lighting program. The timing of the program execution may be coordinated with the frequency of the A.C. power, voltage or current. In an embodiment, the lighting system may coordinate the lighting effect with a transient parameter of the power source or other randomly, periodically or otherwise occurring parameter of the power source. This provides for a synchronized lighting effect without the need for network communication. In an embodiment, the lighting system may include one or more pre-programmed lighting effects and a user interface for selecting one of the lighting effects. Once the effect has been selected, the processor may execute the program in coordination with a parameter of the power source, causing a synchronized generation of the lighting effect.

In one embodiment, a lighting system according to the present invention generates lighting effects in coordination with a reference value. In one aspect, several such lighting systems may be associated with a power source and all of the systems would be coordinated with one another because they would be coordinated with a parameter of the power source. For example, you could attach several lighting systems to a power source in a hallway. Each of the lighting systems may be monitoring and coordinating the execution of their lighting effects with the power source such that each of them is producing the effects in coordination with one another. Each of the lighting systems may be generating a color wash and the color wash effects from each of the lighting systems will remain in sync.

Another aspect of the present invention is an adjustable timing circuit configured to change the timing of the generation of a lighting effect. In an embodiment, a timing circuit is associated with a user interface such that a user can adjust the timing of the generation of the lighting effect. For example, several lighting systems may be associated with a power source in a hallway and each system may be set to a color wash effect. A user may adjust the timing of each of the several systems to begin the execution of the lighting program at a different time. The systems further down the hallway may be adjusted with a increasing delay such that the color wash is offset by certain amounts as the systems progress down the hall. This would result in a staggered effect, and in the case of the staggered color wash, a washing rainbow down the hallway. The timing could be arranged such that, for example, as the first lighting system cycles through blue into the next color, the second system is cycling into blue. In an embodiment, the timing circuit may be provided with a substantially continuous variable timing. In an embodiment, the timing circuit may be provided with predetermined offsets of time periods. Another example of a useful or desirable lighting effect that appears to pass from one lighting system to another is a "chasing effect." The chasing effect may appear to pass a red light, for example, from a first light to a second light to a third. The timing of the generation of the red light may be synchronized via systems according to the principles of the present invention. So, a first light may generate red light for a predetermined time, five seconds or a number of sync cycles or the like. During this period, a second light may be off (i.e. generating no effect) and following this period, the second light may generate the red lighting effect for the same period. This effect may appear to propagate through many lighting systems and appear to be chasing the red light down a hallway, for example. In an embodiment, there may be a delay imposed between two lighting systems generating the effect. For example, the program the lighting system is executing may generate the delay period such that it does not generate the red lighting effect until two seconds or a number of cycles have passed. In another embodiment, a user adjustable timer may be used to generate the delay. The adjustment may be used to create the appearance that it took time to pass the red lighting effect from a first lighting system to a second and so on.

In an embodiment, an adjustable timing circuit may be used to compensate for phase or frequency differences in a given installation. For example, a room may be provided with several electrical outlets supplied by one phase of an A.C. power distribution system and several outlets supplied by another phase of the A.C. power distribution. The timing circuit may be configured to be adjusted to compensate for the phase difference such that the timing of the lighting effects from lighting systems on the two phases are in sync.

While many of the embodiments herein teach of synchronizing the generation of lighting effect, such as a color changing lighting effect, in an embodiment, the synchronization function may be used to synchronize other events as well. For example, the lighting system may be configured to generate a lighting effect at a given time and the time may be measured using the synchronization signal. For example, there may be several lighting systems in an installation and they may be generating a continuously color changing effect in sync. The several lighting systems may be programmed to change modes, into a fixed color mode for example, after they have generated the color changing effect for a period of five minutes. A synchronizing signal may be generated from the peak, zero crossing, or some other parameter of an A.C.

power line and this signal may be used to calculate, or measure, the five minute period. In this example, the several lighting systems would stop the generation of the color changing effect and go into the fixed color mode at the same time because they would be generating the lighting effect in sync with a synchronization signal. In an embodiment, the timing, or synchronization, of events may be made in absolute time (e.g. knowing or measuring the frequency and generating a real time clock or known rate clock pulse) or the timing may be in relative measures (e.g. not knowing the real time occurrence of a parameter but synchronizing to the generation of the occurrence).

There are many environments where a system according to the present invention may be used such as indoor lighting, outdoor lighting, landscape lighting, pool lighting, spa lighting, accent lighting, general lighting, walkway lighting, pathway lighting, guidance lighting systems, decorative lighting, informative lighting, or any other area or situation where synchronized lighting effects are desirable or useful.

FIG. 1 illustrates a lighting system 100 according to the principles of the present invention. Lighting system 100 may include one or more LEDs 104A, 104B, and 104C. The LEDs 104 may be provided on a platform 128. Where more than one LED is used in the lighting system 100, the LEDs may be mounted on the platform 128 such that light projected from the LEDs is mixed to project a mixed color. In an embodiment, the LEDs 104A, 104B, and 104C may produce different colors (e.g. 104A red, 104B green, and 104C blue). The lighting system 100 may also include a processor 102 wherein the processor 102 may independently control the output of the LEDs 104A, 104B, and 104C. The processor may generate control signals to run the LEDs such as pulse modulated signals, pulse width modulated signals (PWM), pulse amplitude modulated signals, analog control signals or other control signals to vary the output of the LEDs. In an embodiment, the processor may control other circuitry to control the output of the LEDs. The LEDs may be provided in strings of more than one LED that are controlled as a group and the processor 102 may control more than one string of LEDs. A person with ordinary skill in the art would appreciate that there are many systems and methods that could be used to operate the LED(s) and or LED string(s) and the present invention encompasses such systems and methods. In an embodiment, a processor may be configured to control an illumination source that is not an LED. For example, the system may contain an incandescent, halogen, fluorescent, high intensity discharge, metal halide, or other illumination source and the processor may be configured to control the intensity or other aspect of the illumination source. In an embodiment, the processor may be configured to control a filter, filter wheel, a filter including more than one color, movable filters, multiple filters or the like in order to filter light projected by the lighting system.

A lighting system 100 according to the principles of the present invention may generate a range of colors within a color spectrum. For example, the lighting system 100 may be provided with a plurality of LEDs (e.g. 104A–C) and the processor 102 may control the output of the LEDs such that the light from two or more of the LEDs combine to produce a mixed colored light. Such a lighting system may be used in a variety of applications including displays, room illumination, decorative illumination, special effects illumination, direct illumination, indirect illumination or any other application where it would be desirable. Many such lighting systems may be networked together to form large networked lighting applications.

In an embodiment the LEDs 104 and or other components comprising a lighting system 100 may be arranged in a housing. The housing may be configured to provide illumination to an area and may be arranged to provide linear lighting patterns, circular lighting patterns, rectangular, square, or other lighting patterns within a space or environment. For example, a linear arrangement may be provided at the upper edge of a wall along the wall-ceiling interface and the light may be projected down the wall or along the ceiling to generate certain lighting effects. In an embodiment, the intensity of the generated light may be sufficient to provide a surface (e.g. a wall) with enough light that the lighting effects can be seen in general ambient lighting conditions. In an embodiment, such a housed lighting system may be used as a direct view lighting system. For example, such a housed lighting system may be mounted on the exterior of a building where an observer may view the lighted section of the lighting system directly. The housing may include optics such that the light from the LED(s) 104 is projected through the optics. This may aid in the mixing, redirecting or otherwise changing the light patters generated by the LEDs. The LED(s) 104 may be arranged within the housing, on the housing or otherwise mounted as desired in the particular application. In an embodiment, the housing and lighting system 100 may be arranged as a device that plugs into a standard wall electrical outlet. The system may be arranged to project light into the environment. In an embodiment, the system is arranged to project light onto a wall, floor, ceiling or other portion of the environment. In an embodiment, the lighting system is configured to project light into a diffusing optic such that the optic appears to glow in the color projected. The color may be a mixed, filtered or otherwise altered color of light and the system may be configured to change the color of the light projected onto the optic.

The lighting system 100 may also include memory 114 wherein one or more lighting programs and or data may be stored. The lighting system 100 may also include a user interface 118 used to change and or select the lighting effects generated by the lighting system 100. The communication between the user interface and the processor may be accomplished through wired or wireless transmission. The processor 102 may be associated with memory 114, for example, such that the processor executes a lighting program that was stored in memory. The user interface may be configured to select a program or lighting effect from memory 114 such that the processor 102 can execute the selected program.

The lighting system 100 may also include sensors and or transducers and or other signal generators (collectively referred to hereinafter as sensors). The sensors may be associated with the processor 102 through wired or wireless transmission systems. Much like the user interface and network control systems, the sensor(s) may provide signals to the processor and the processor may respond by selecting new LED control signals from memory 114, modifying LED control signals, generating control signals, or otherwise change the output of the LED(s). In an embodiment, the lighting system 100 includes a communication port 124 such that control signals can be communicated to the lighting system. The communication port 124 may be used for any number of reasons. For example, the communication port 124 may be configured to receive new programs to be stored in memory or receive program information to modify a program in memory. The communication port 124 may also be used to transmit information to another lighting or non-lighting system. For example, a lighting system 100 may be arranged as a master where it transmits information to other lighting systems either through a network or through the power lines. The master lighting system may generate a signal that is multiplexed with the power signal such that another lighting systems on the same power system will monitor and react to the parameter. This may take the form of a timing gun in the system where all of the lighting systems are generating their own lighting effects from memory but the timing of the lighting effects is accomplished by monitoring the parameter on the power source.

In an embodiment, the lighting system 100 includes a power monitoring system 130. The power monitoring system may be associated with a power source (not shown). In an embodiment, the system 130 is associated with a power source that is also supplying the lighting system 100 with power. In an embodiment, the processor 102 is associated with a clock pulse generator (not shown). The clock pulse generator may generate clock pulses from an A.C. power source that is associated with the power monitoring circuit. The clock generator may filter the AC power and form a clock pulse in sync with the AC power cycle. In an embodiment, the clock pulse may be generated in phase with a portion of the AC wave. A method of generating the clock pulse may comprise detecting and filtering a 110 VAC 60 Hz waveform to provide a 60 Hz, 120 Hz or other frequency clock pulse. The clock pulse may then be used to provide a synchronizing clock to the circuit of an illumination device. For example, a peak threshold circuit combined with monostable multivibrator is an example of such a circuit. A person with ordinary skill in the art will know of other methods of creating a clock pulse from an AC line and that generating the clock pulse may be timed with other parameters of the power source, such as the voltage, current, frequency or other parameter. For example, a system may utilize a single resistor connected between the AC line, and a microprocessor input pin. This allows a microprocessor to determine, at any point in time, whether the AC voltage is positive or negative, and software methods can then be used to count transitions from one state to the other, establishing a timing reference. Various other characteristics of an AC waveform may be monitored to establish a timing reference, including, for example, monitoring changes in waveform slope, thresholding at various voltages (either constant or varying), thresholding of the current drawn by a load (including the lamp itself), and other methods. It should also be understood that there are a virtually unlimited number of circuits which can be designed to extract timing information from the AC line, and that the purposes here is not to suggest a limited subset of such circuits but rather to provide some illustrative examples.

In an embodiment, the clock pulse is used to synchronize the generation of the lighting effect generated by the lighting system 100. For example, the processor 102 of the lighting system 100 may be configured to execute a lighting program from memory 114 and the timing of the execution may be synchronized with the clock pulse. While this embodiment teaches of generating clock pulses from a periodically occurring condition or parameter of the power source, it should be understood that a momentary condition of the power source may be used as well. For example, the power source may transmit transients from any number of sources and the lighting system may be configured to monitor such transients and coordinate the generation of the lighting effects with the transients. Generally, the transients will be communicated, or passed, to all of the devices associated with the power source so all of the lighting systems associated with a given power source will receive the same transient at effectively the same time such that all the lighting devices will remained synchronized. A transient may be a voltage, current, power, or other transient.

Another aspect of the present invention is a system and method for adjusting the timing of the generation of a lighting effect. In an embodiment, the processor 102 of a lighting system 100 may be associated with a timing circuit 132. The timing circuit may be arranged to provide an adjustable timing of the generation of the lighting effect. For example, the timing circuit may be associated with a user interface to allow a user to adjust the timing as desired. The adjustment may be provided as a substantially continuous adjustment, segmented adjustment, predetermined period adjustments, or any other desirable adjustment.

Most homes and offices will have a number of branch circuits on separate circuit breakers or fuses. With prior art devices, it is difficult in these situations and undesirable to switch entire circuits on and off to provide the synchronizing power-up. If the individual elements are plugged into separate outlets and they are on separate circuits, this makes it difficult to then synchronize the individual devices and fixtures. An aspect of the invention is to provide a system to adjust the cycle that each device is operating on. In effect, this adjusts the phase of the generated lighting effect such that the devices can be synchronized. This can take the form of an encoder, button, switch, dial, linear switch, rotary dial, trimmer pot, receiver, transceiver, or other such device which, when turned, pressed, activated or communicated to, adjusts and shifts the part of the cycle that the device is in. A button push, for example, can halt the action of the device and the user can wait for another device to 'catch up' with the halted device and release at the correct part of the cycle. If the effect is rapid, as in a fast color wash, then the button push can be used to shift the effect slowly while it continues. That is, actuation of the adjustment system may result in changing the timing by just a few percent to slow down or speed up. If the adjustment device is a receiver or transceiver, an external signal may be provided to the illumination device through IR, RF, microwave, telephone, electromagnetic, wire, cable, network or other signal. For example, a remote control device may be provided and the remote control device may have a button, dial, or other selection device such that when the selection device is activated a signal is communicated to the illumination system and the phase of the relation between the program execution and the clock pulse may be adjusted.

In an embodiment, the lighting device may generate a sound to assist with the timing adjustment. For example, the sound may be similar to a metronome to provide the user with a reference by which to set the timing system. For example, several lighting systems may require synchronization and an audio tone (e.g. timed chirps) may be provided to assist in the setting. Several lighting devices may be generating the audio tone and a user may go to each light and adjust the timing until the user hears synchronization of the tones.

In an embodiment, an adjustment device may also be provided that shifts the phase of the program execution by a predetermined amount. For example, the first illumination device may remain in sync with the AC line while a second illumination system could be set to begin the cycle thirty seconds after the first and then a third device thirty seconds after the second. This may be used, for example, to generate a moving or chasing rainbow effect in a hallway. A predetermined amount may be a portion of the phase of the power waveform, such as ninety degree, one hundred eighty degree, two hundred seventy degree or other phase shift of the power waveform.

An illumination system according to the principles of the present invention may include a user interface 118 wherein the user interface 118 is used to select a program, program parameter, make an adjustment or make another user selection. One of the user selections could be a synchronization mode where the system coordinates its activities with a clock pulse. The user interface 118 could be used to select a synchronization mode and or a color effects mode. In an embodiment, the user interface may be a button. The button may be held down for a predetermined period to set the unit into the synchronization mode. The button could then be used to select the program to play in sync with the clock pulse. Several buttons, dials, switches or other user interfaces could also be used to accomplish these effects.

In an embodiment, a power cycle could also initiate a synchronous mode or change the phase of the sync. An energy storage element (not shown) could also be used (e.g. capacitor in an RC circuit) in the system to provide a high logic signal or a low logic signal. The energy storage element could be associated with a power supply and with the processor in the system. When the power to the system is de-energized and re-energized within a predetermined period of time, the system could go into a synchronous mode. The power cycle could also cause the phase of the execution of the program with respect to a clock pulse to be changed.

In an embodiment, the adjustment of the timing circuit can be used to provide a phase adjustment for other pleasing effects. For example, if a number of nightlights or other lighting fixtures are plugged into outlets along a hallway, it may be desirable to have a rainbow move down the hallway such that the red, orange, yellow, green, blue, indigo, violet (ROYGBIV) sequence slowly moves and shifts down the hall over time. By powering up all the units in a hallway and the using the phase adjustment to select the part of a cycle to be in, the effect can be generated without additional means of communication or control. Another solution is a fixed adjustment for phase control—a dial, for example, that provides a fixed setting or onboard memory that stores phase information. In this way, a power flicker or failure or an inadvertently switched light switch won't require resetting all of the devices. In an embodiment, a lighting system may include memory wherein timing, phase, adjustment or other information is stored. In an embodiment, the memory may be non-volatile, battery-backed or otherwise arranged to provide recall of the information upon re-energization of the system. Phase adjustment can be accomplished through a button, for example, that is added to the device that allows the user to press and stop the effect until another light fixture 'catches up' with the current display. In this way, only one other light needs to be visible to any other to allowing synchronization when a user is accomplishing the task by him or herself. Another mode is to allow a 'fast-forward' of the display until it catches up to the reference display. When the two are at the same point in the sequence then the button is released and the two will remain in synchronization from that point on.

Another aspect of the present invention is a system and method for generating and communicating clock pulses from a master lighting system to a slave system. In an embodiment, the processor 102 may generate a clock pulse signal, either associated with a power source or not, and then communicate a clock pulse signal through the communication port 124 or over the power line to another device. The communication may be accomplished through wired or wireless communication systems. In this embodiment, the clock pulse does not need to be generated from a parameter of the power source, although it could be, because the master (i.e. the lighting device generating the clock pulse) is not only generating the pulse, it is communicating the pulse to other device(s). The other device(s) may not be monitoring a parameter of a power source because it will synchronize the generation of its lighting effect in coordination with the received pulse signal. In an embodiment, a slave lighting system may be configured to retransmit the clock pulse it received as a way of coordinating several lighting systems. This may be useful where the communication medium is limited and cannot otherwise reach particular lighting systems. In an embodiment, the clock pulse generator may reside separately from a lighting system.

Figure 2:
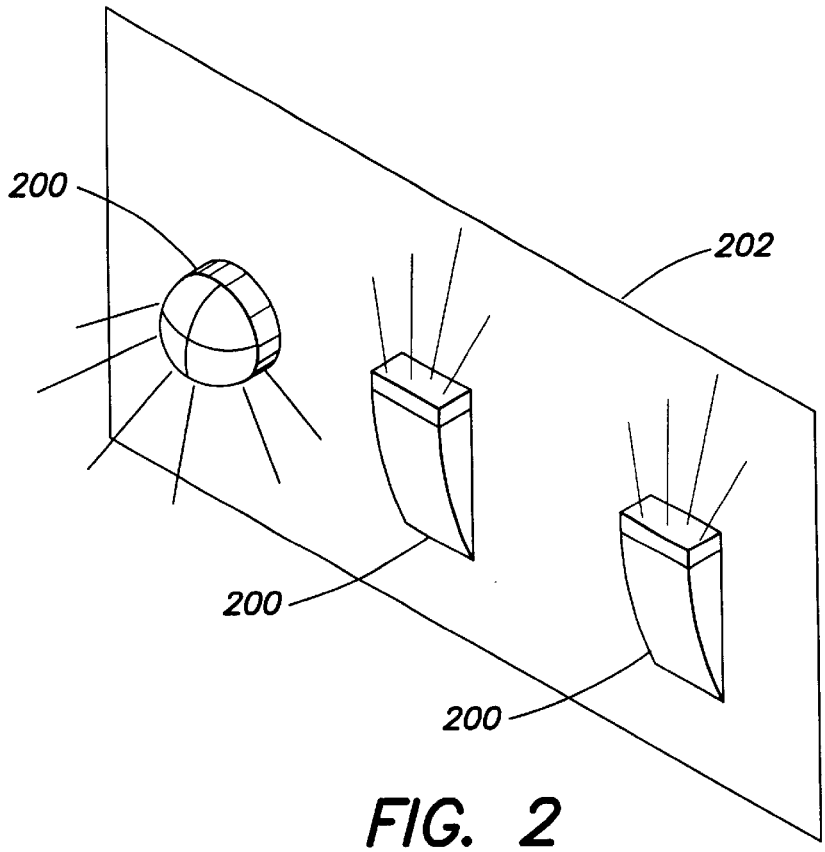
FIG. 2 illustrates an environment with lights according to the principles of the present invention.
Figure 3:
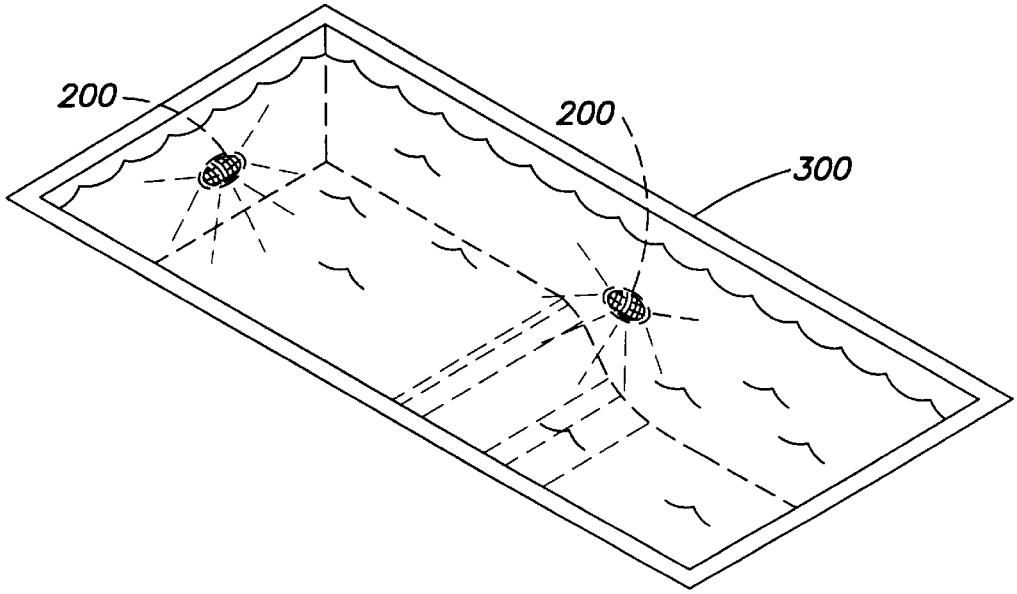
FIG. 3 illustrates an environment with lights according to the principles of the present invention.

FIGS. 2 and 3 illustrate environments where a system(s) according to the principles of the present invention would be useful. FIG. 2 illustrates a wall 202 with several lights 200. In an embodiment, the lights 200 include a lighting system 100 and are adapted to be connected to a wall electrical outlet (not shown). There are many adapters that may be used to connect the light 200 with power such as a spade plug adapter, screw base adapter, Edison base adapter, wedge base adapter, pin base adapter, or any number of other adapters. FIG. 3 illustrate a swimming pool, hot tub, spa or the like wherein there are lights 200 that may be generating synchronized lighting effects through systems as described herein. Systems according to principles of the present invention may be used in a vast variety of environments and the environments of FIGS. 2 and 3 are provided for illustrative purposes only.

Figure 4:
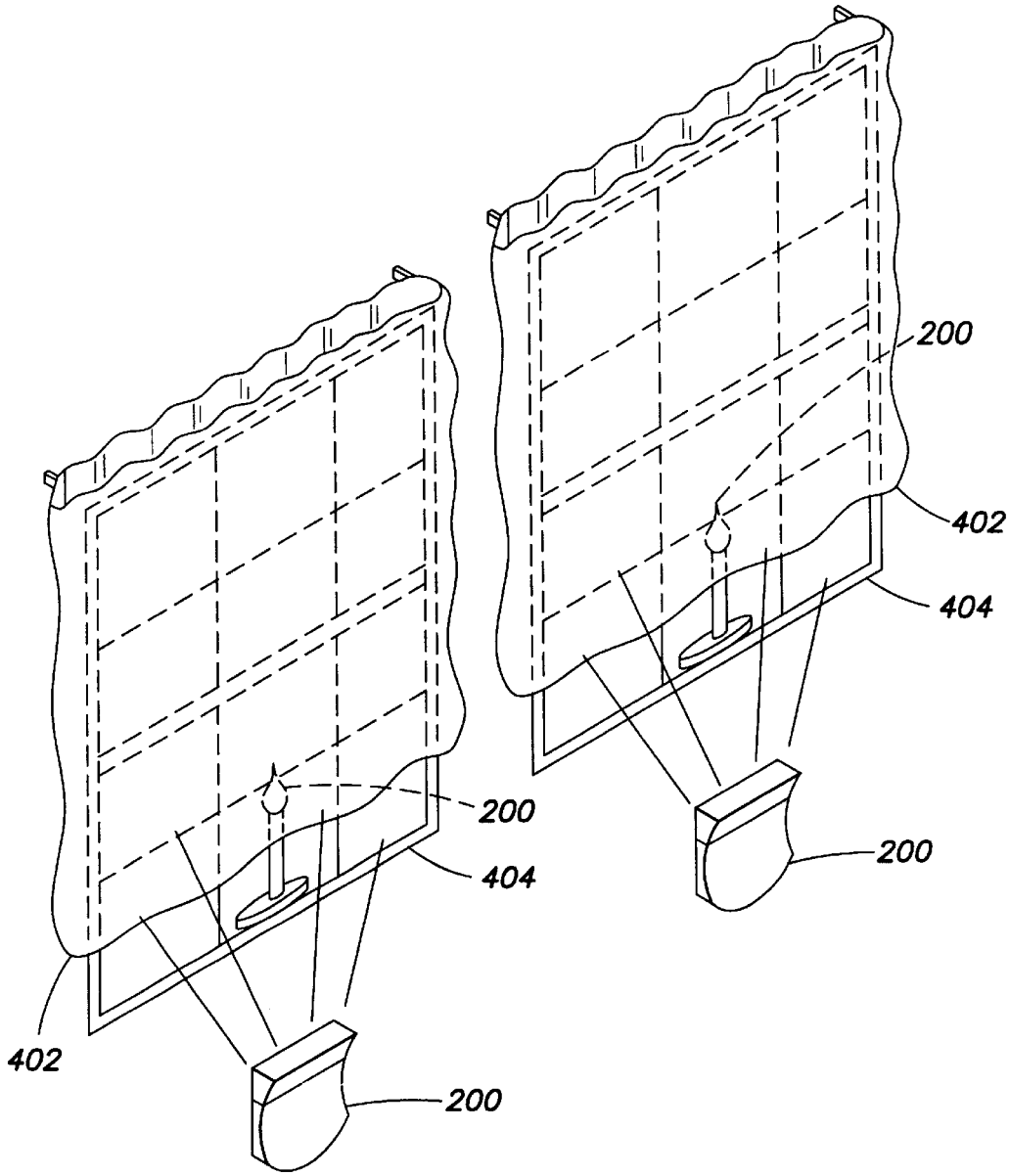
FIG. 4 illustrates an environment with lights according to the principles of the present invention.

FIG. 4 illustrates an environment according to the principles of the present invention. The environment may include a window 404, a window shade 402 and lights 200. The lights may be arranged as direct view lights as in the candle style lights on the sill of the window, or the lights may be arranged as indirect view lights as with the wall mounted lights projecting light onto the shade 402. In this example, the wall mounted lights 200 are arranged to project light onto the shade. The light may be projected onto the front surface, back surface or through the end of the surface. This arrangement provides for lighted shades and may be used to create lighting effects to be viewed from the outside of a house, for example. The several lights 200 may be synchronized to provide synchronized lighting effects. For example, the user may want to generate a lighting effect that sequentially generates red, white and blue light. The user may want all of the windows to display the same colors at the same time or the user may want to have the colors appear to move from window to window.

While many of the embodiments disclosed herein teach of synchronizing lighting systems without the use of a network, a network may provide the communication system used to communicate coordinating signals between lighting systems according to the principles of the present invention. A lighting system may be part of a network, wired or wireless network, and the lighting system may receive clock pulse signals from the network to coordinate the execution of a program from memory 114. The memory 114 may be self-contained and several lighting systems associated with the network may be generating lighting effects from their own memory systems. The network provided synchronization signals may be used by each of the lighting devices associated with the network to provide synchronized lighting effects. While some embodiments herein describe arrangements of master/slave lighting systems, it should be understood that a separate synchronizing signal source could be used to generate and communicate the signals, through wired or wireless communication, to the lighting system(s).

While the LEDs 104A, 104B, and 104C in FIG. 1 are indicated as red, green and blue, it should be understood that the LED(s) in a system according to the present invention might be any color including white, ultraviolet, infrared or other colors within the electromagnetic spectrum. As used herein, the term "LED" should be understood to include light emitting diodes of all types, light emitting polymers, semiconductor dies that produce light in response to current, organic LEDs, electro-luminescent strips, and other such systems. In an embodiment, an "LED" may refer to a single light emitting diode having multiple semiconductor dies that are individually controlled. It should also be understood that the term "LED" does not restrict the package type of the LED. The term "LED" includes packaged LEDs, non-packaged LEDs, surface mount LEDs, chip on board LEDs and LEDs of all other configurations. The term "LED" also includes LEDs packaged or associated with material (e.g. a phosphor) wherein the material may convert energy from the LED to a different wavelength.

The term "processor" may refer to any system for processing electrical, analog or digital signals. The term processor should be understood to encompass microprocessors, microcontrollers, integrated circuits, computers and other processing systems as well as any circuit designed to perform the intended function. For example, a processor may be made of discrete circuitry such as passive or active analog components including resistors, capacitors, inductors, transistors, operational amplifiers, and so forth, and/or discrete digital components such as logic components, shift registers, latches, or any other component for realizing a digital function.

The term "illuminate" should be understood to refer to the production of a frequency of radiation by an illumination source. The term "color" should be understood to refer to any frequency of radiation within a spectrum; that is, a "color," as used herein, should be understood to encompass frequencies not only of the visible spectrum, but also frequencies in the infrared and ultraviolet areas of the spectrum, and in other areas of the electromagnetic spectrum. It should also be understood that the color of light can be described as its hue, saturation and or brightness.

While many of the embodiments herein describe systems using LEDs, it should be understood that other illumination sources may be used. As the terms are used herein "illumination sources" and "lighting sources" should be understood to include all illumination sources, including LED systems, as well as incandescent sources, including filament lamps, pyro-luminescent sources, such as flames, candle-luminescent sources, such as gas mantles and carbon arch radiation sources, as well as photo-luminescent sources, including gaseous discharges, fluorescent sources, phosphorescence sources, lasers, electro-luminescent sources, such as electro-luminescent lamps, light emitting diodes, and cathode luminescent sources using electronic satiation, as well as miscellaneous luminescent sources including galvano-luminescent sources, crystallo-luminescent sources, kine-luminescent sources, thermo-luminescent sources, triboluminescent sources, sonoluminescent sources, and radioluminescent sources. Illumination sources may also include luminescent polymers capable of producing primary colors.

While many of the embodiments illustrated herein describe the color wash effect, it should be understood that the present invention encompasses many different lighting effects. For example, the present invention encompasses continually changing lighting effects, substantially continually changing lighting effects, abruptly changing lighting effects, color changing lighting effects, intensity changing lighting effects, gradually changing lighting effects, or any other desirable or useful lighting effect.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

We claim:

1. A lighting apparatus, comprising:

a processor wherein the processor is configured to control a color-changing lighting effect generated by the lighting apparatus;

wherein the processor is further configured to monitor an operating power source; and wherein the processor is further configured to synchronize the color-changing lighting effect in coordination with a parameter of the operating power source.

2. The apparatus of claim 1, wherein the parameter comprises a periodically changing parameter of the operating power source.

3. The apparatus of claim 2, wherein the periodically changing parameter comprises periodically changing voltage.

4. The apparatus of claim 2, wherein the periodically changing parameter comprises periodically changing frequency.

5. The apparatus of claim 2, wherein the periodically changing parameter comprises periodically changing current.

6. The apparatus of claim 2, wherein the periodically changing parameter comprises periodically changing power.

7. The apparatus of claim 2, wherein the power source comprises an A.C. power source.

8. The apparatus of claim 7, wherein the frequency of the A.C. power source is approximately 60 Hz.

9. The apparatus of claim 7, wherein the frequency of the A.C. power source is approximately 50 Hz.

10. The apparatus of claim 1, wherein the processor is configured to monitor a momentarily changing parameter of the operating power source.

11. The apparatus of claim 10, wherein the momentary changing parameter comprises a transient.

12. The apparatus of claim 11, wherein the transient comprises a voltage transient.

13. The apparatus of claim 11, wherein the transient comprises a current transient.

14. The apparatus of claim 11, wherein the transient comprises a power transient.

15. The apparatus of claim 1, wherein the power source supplies power to the lighting apparatus.

16. The apparatus of claim 1, wherein the lighting apparatus comprises a red, green, blue lighting apparatus.

17. The apparatus of claim 1, wherein the lighting apparatus comprises an LED lighting apparatus.

18. The apparatus of claim 17, wherein the LED lighting apparatus further comprises at least two LEDs of different colors wherein the at least two LEDs are independently controlled by the processor.

19. The apparatus of claim 17, wherein the LED lighting apparatus further comprises at least three LEDs of different colors wherein the at least three LEDs are independently controlled by the processor.

20. The apparatus of claim 19 wherein the at least three colors comprise red, green, and blue.

21. The apparatus of claim 1, further comprising:

a light source;

at least one movable filter wherein the filter is associated with the light source such that filtered light is projected from the lighting apparatus; and wherein the processor is further configured to position the movable filter with respect to the light source.

22. The apparatus of claim 21 wherein the at least one movable filter comprises at least two different colored filters.

23. The apparatus of claim 1, further comprising:

a timing adjustment circuit wherein the timing adjustment circuit is configured to adjust the timing of the generation of the color-changing lighting effect with respect to the parameter.

24. The apparatus of claim 23, wherein the timing adjustment circuit is associated with a user interface.

25. The apparatus of claim 24, wherein the user interface provides a range of adjustment.

26. The apparatus of claim 24, wherein the user interface provides a plurality of settings of adjustment.

27. The apparatus of claim 26, wherein the plurality of settings comprises a plurality of predetermined timing settings.

28. The apparatus of claim 27, wherein the power source is an A.C. power source.

29. The apparatus of claim 28, wherein the predetermined timing settings comprises a 90-degree phase shift from the phase of the A.C. power source.

30. The apparatus of claim 28, wherein the predetermined timing settings comprises a 180-degree phase shift from the phase of the A.C. power source.

31. The apparatus of claim 28, wherein the predetermined timing settings comprises a 270-degree phase shift from the phase of the A.C. power source.

32. The apparatus of claim 1, wherein the color-changing lighting effect comprises a substantially continuously color-changing lighting effect.

33. The apparatus of claim 1, wherein the color-changing lighting effect comprises an abruptly color-changing lighting effect.

34. The apparatus of claim 1, wherein the lighting apparatus further comprises a plurality of lighting effects.

35. The apparatus of claim 34, wherein at least one of the plurality of lighting effects is selectable through a user interface.

36. The apparatus of claim 35, wherein the processor is further configured to synchronize a selected lighting effect in coordination with the parameter.

37. A lighting apparatus, comprising:

a processor wherein the processor is configured to execute a program to control a lighting effect generated by the lighting apparatus;

the processor is further configured to monitor an operating power source; and the processor is further configured to synchronize the execution of the program in coordination with a parameter of the operating power source.

38. A lighting apparatus, comprising:

a processor wherein the processor is configured to control a lighting effect generated by the lighting apparatus;

the processor is further configured to monitor a parameter of an operating power source; and the processor is further configured to synchronize the generation of the lighting effect in coordination with the parameter.

39. The apparatus of claim 38 wherein the parameter comprises a periodic parameter.

40. The apparatus of claim 39, wherein the periodic parameter comprises a frequency of the power supplied by the power source.

41. The apparatus of claim 39, wherein the periodic parameter comprises a periodic voltage supplied by the power source.

42. The apparatus of claim 39, wherein the periodic parameter comprises a periodic current supplied by the power source.

43. The apparatus of claim 38 wherein the parameter comprises a momentary parameter.

44. The apparatus of claim 43 wherein the momentary parameter comprises a transient parameter.

45. A method of generating a lighting effect, comprising the steps of: providing a lighting apparatus;

providing power to the lighting apparatus;

causing the lighting apparatus to monitor at least one parameter of the power provided to the lighting apparatus; and causing the lighting apparatus to generate a lighting effect in sync with the at least one parameter.

46. The method of claim 45 wherein the lighting effect comprises a color changing lighting effect.

47. The method of claim 46 wherein the at least one parameter comprises a periodically changing parameter.

48. The method of claim 47 wherein the periodically changing parameter comprises a periodically changing voltage.

49. The method of claim 47 wherein the periodically changing parameter comprises a periodically changing current.

50. The method of claim 47 wherein the periodically changing parameter comprises a periodically changing frequency.

51. The method of claim 45 wherein the at least one parameter comprises a momentarily changing parameter.

52. The method of claim 51 wherein the momentarily changing parameter comprises a transient.

53. The method of claim 52 wherein the transient comprises a transient voltage.

54. The method of claim 52 wherein the transient comprises a transient current.

55. The method of claim 52 wherein the transient comprises a transient power.

56. The method of claim 45, further comprising the steps of:

providing an adjustment circuit to adjust the synchronization of the generation of the lighting effect with the at least one parameter.

57. The method of claim 56, further comprising the steps of:

adjusting the adjustment circuit.

58. The method of claim 56 wherein the adjustment circuit is configured to provide a substantially continuous range of adjustment.

59. The method of claim 56 wherein the adjustment circuit is configured to provide a plurality of adjustment settings.

60. A lighting apparatus, comprising:

a processor wherein the processor is configured to execute a program to control a lighting effect generated by the lighting apparatus;

the processor is further configured to receive a synchronizing signal from an external source; and the processor is further configured to synchronize the execution of the program in coordination the synchronizing signal.

61. The apparatus of claim 60 wherein the processor is associated with memory wherein the program is stored.

62. The apparatus of claim 61 wherein the memory is internal to the lighting apparatus.

63. The apparatus of claim 60 wherein the external source is another lighting apparatus.

64. The apparatus of claim 60 wherein the external source is a clock generator.

65. The apparatus of claim 60 wherein the processor is configured to receive the synchronizing signal through wired communication.

66. The apparatus of claim 60 wherein the processor is configured to receive the synchronizing signal through wireless communication.

67. The apparatus of claim 60 wherein the processor is configured to receive the synchronizing signal through a power system.

68. The apparatus of claim 67 wherein the power system provides power to the lighting apparatus.

69. The apparatus of claim 60 wherein the lighting apparatus comprises an LED lighting apparatus.

70. The apparatus of claim 69 wherein the LED lighting apparatus is configured to produce controlled colored lighting.

* * * * *

UNITED STATES PATENT AND TRADEMARK OFFICE

CERTIFICATE OF CORRECTION

PATENT NO. : 6,801,003 B2 
DATED : October 5, 2004
INVENTOR(S) : Eric K. Schanberger and Kevin J. Dowling It is certified that error appears in the above-identified patent and that said Letters Patent is hereby corrected as shown below:

Column 1,
Lines 33-34, please delete "Each of the foregoing applications is hereby incorporated herein by reference."

Signed and Sealed this

Twenty-eighth Day of December, 2004

JON W. DUDAS
*Director of the United States Patent and Trademark Office*